US006686543B2

(12) United States Patent
Massey

(10) Patent No.: US 6,686,543 B2
(45) Date of Patent: Feb. 3, 2004

(54) RADIO FREQUENCY SUPPRESSING CABLE

(75) Inventor: Peter J. Massey, Horley (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/153,264

(22) Filed: May 22, 2002

(65) Prior Publication Data

US 2002/0189846 A1 Dec. 19, 2002

(30) Foreign Application Priority Data

Jun. 8, 2001 (GB) ..... 0113928

(51) Int. Cl.[7] ..... H01B 7/00; H01B 7/18

(52) U.S. Cl. ..... 174/110 R; 174/113 R; 174/120 R; 174/120 SC

(58) Field of Search ..... 174/36, 102 SC, 174/102 P, 105 R, 106 R, 105 SC, 106 SC, 110 R, 110 AR, 110 S, 113 R, 120 R, 120 C, 120 SC, 120 AR, 120 SR

(56) References Cited

U.S. PATENT DOCUMENTS

| | | | | | |
|---|---|---|---|---|---|
| 4,075,421 | A | * | 2/1978 | McCullough | 174/120 SC |
| 4,104,600 | A | * | 8/1978 | Mayer | 333/181 |
| 4,347,487 | A | * | 8/1982 | Martin | 333/1 |
| 4,426,636 | A | | 1/1984 | Ohta | 338/314 |
| 4,510,468 | A | * | 4/1985 | Mayer | 333/12 |
| 4,576,827 | A | * | 3/1986 | Hastings et al. | 427/462 |
| 5,034,719 | A | * | 7/1991 | Brown et al. | 338/66 |
| 5,057,812 | A | * | 10/1991 | Yukawa et al. | 338/66 |
| 5,171,938 | A | * | 12/1992 | Katsumata et al. | 174/36 |
| 5,574,249 | A | * | 11/1996 | Lindsay | 174/135 R |
| 5,824,958 | A | * | 10/1998 | Higashikozono et al. | 174/105 R |
| 6,225,565 | B1 | * | 5/2001 | Prysner | 174/120 SC |
| 6,239,378 | B1 | * | 5/2001 | Shephard | 174/110 S |

FOREIGN PATENT DOCUMENTS

| | | | | |
|---|---|---|---|---|
| EP | 0 520 599 A2 | * | 1/1992 | H01B/11/10 |
| EP | 0520599 A2 | | 12/1992 | H01B/11/10 |
| EP | 0596869 A2 | | 5/1994 | H01B/11/10 |
| GB | 2229313 A | | 9/1990 | H01B/11/06 |

* cited by examiner

*Primary Examiner*—William H. Mayo III
(74) *Attorney, Agent, or Firm*—Gregory L. Thorne

(57) ABSTRACT

A radio frequency suppressing cable has at least one conductor and a resistive layer surrounding the at least one conductor and insulated from the at least one conductor. The bulk resistance of material included in the resistive layer is greater than that of the material of the at least one conductor. In addition, the thickness of the resistive layer is greater than the skin depth δ for the radio frequency, where $$\delta = \frac{1}{\sqrt{\pi \sigma f \mu_r \mu_o}}$$

where σ is the conductivity of the material,
f is the frequency,
$\mu_r$ is the magnetic permeability relative to that of free space, and
$\mu_o$ is the magnetic permeability of free space.

11 Claims, 1 Drawing Sheet

RADIO FREQUENCY SUPPRESSING CABLE

BACKGROUND OF THE INVENTION

1. Technical Field

The present invention relates to a radio frequency suppressing cable for suppressing the unwanted emission of radio frequency signals. Such a cable may be used for interconnecting devices and/or equipment such as may be used for radio frequency test and measurement purposes.

2. Description of the Related Art

In many equipments and fixed and portable installations there is a requirement to interconnect circuit boards, devices and accessories with flexible conductive links. However in order to comply with regulations relating to radio frequency emissions, it is desired to suppress the leakage of radio frequency radiation from these flexible conductive links. One well known technique is to use coaxial cables in which a conductor is insulated from and surrounded by a tubular, woven metallic screening conductor which in operation is usually earthed. The degree of flexibility of many co-axial cables is limited thus making them suitable for use in fixedly located equipments and static applications, such as TV antenna leads. The woven metallic screening conductor has the drawback that it allows spurious currents to flow down the outside of the cable. In certain applications standing waves have been reported as being supported on cables used in personal applications and this has lead to speculation of high specific absorption rate (SAR) due to coupling between these standing waves and the user.

In another known technique for reducing unwanted radio signal propagation, a ferrite bead is wrapped around a cable at a location which is as close as possible to the point of attachment of the cable to the equipment generating radio frequency currents. A drawback to using a ferrite bead or a plurality of such beads is that it or they are rigid thereby reducing the flexibility of the cable and also the radiation is suppressed only in the vicinity of the ferrite beads and not between them.

SUMMARY OF THE INVENTION

An object of the present invention is to provide radio frequency suppression substantially along the entire length of a cable.

According to the present invention there is provided a cable comprising at least one conductor and a resistive layer surrounding and being insulated from the at least one conductor, wherein the bulk resistance of material comprising the resistive layer is greater than that of the material comprising the at least one conductor.

In an embodiment of the present invention the thickness of the resistive layer is greater than the skin depth δ, the skin depth δ being equal to $$\delta = \frac{1}{\sqrt{\pi \sigma f \mu_r \mu_o}}$$

where σ is the conductivity of the material, f is the frequency, $\mu_r$ is the magnetic permeability relative to that of free space, and $\mu_o$ is the magnetic permeability of free space.

A cable made in accordance with the present invention provides continuous radio frequency suppression along its length. Depending on the number and size of the conductors in the cable it may be relatively thin and flexible so that it can be used with portable equipment and accessories or less flexible so that it can be used to interconnect fixedly mounted installations. The provision of the resistive layer serves to suppress any standing waves which may otherwise be present.

The thickness of the resistive layer may be between 2 and 10 times the skin depth.

The resistive material may comprise a carbon based material such as graphite, woven carbon fibre made from a graphite filament or graphite loaded plastics.

BRIEF DESCRIPTION OF THE DRAWINGS

The present invention will now be described, by way of example, with reference to the accompanying drawings, wherein.

DETAILED DESCRIPTION OF THE INVENTION

Figure 1:
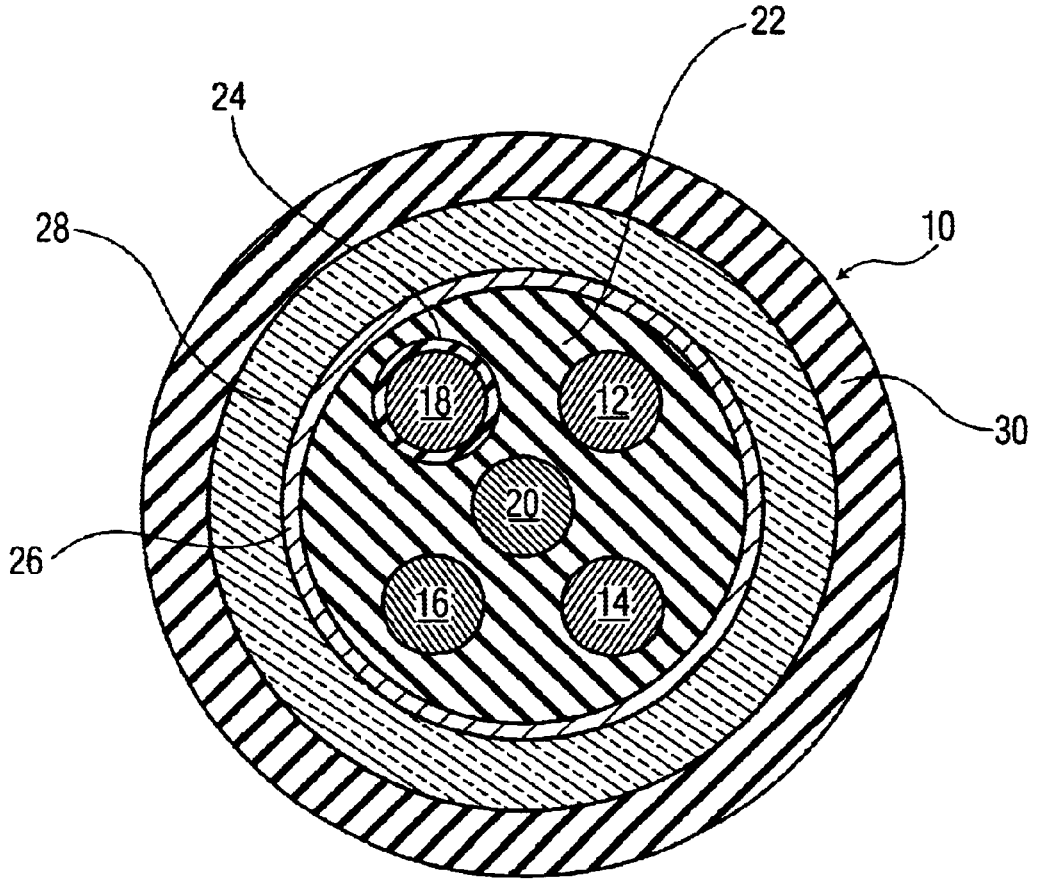
FIG. 1 represents a cross section through an embodiment of a low frequency multicore cable made in accordance with the present invention.

In the drawings the same reference numerals have been used to indicate corresponding features.

The cable shown in FIG. 1 comprises five conductors 12, 14, 16, 18, 20 mutually insulated from each other in an insulating space 22. The conductor 18 has an additional insulating layer 24. The insulating space 22 is filled with an insulating plastics if the respective conductors do not have their own insulating cover. However if they are covered then as an alternative the insulating space 22 can comprise an air dielectric. A coaxial conductive shielding surrounds the insulating space 22. An outer insulating plastics covering 30 is provided and a resistive layer 28 is disposed between the conductive shielding 26 and the outer covering 30.

The cross sectional size of the cable 10 and the materials comprising its respective component parts are selected for the particular end user application.

The conductors 12, 14, 16, 18 and 20 may be solid or comprise several strands and can be of any one of the materials normally used in cable manufacture such as copper, aluminium and steel. The material filling the insulating space 22 and forming the insulating layer 24 may comprise materials commonly used in cable making such as PVC (Polyvinyl chloride), silicone based plastics and rubber and PTFE (Polytetrafluoroethylene).

The resistive layer 28 is provided to suppress emissions of radio frequency signals from the conductors 12, 14, 16, 18 or 20 and the conductive shielding. In order to be able to function effectively it is necessary that the bulk resistance of the material used in the resistive layer 28 is firstly much greater than that of the conductive materials but secondly is not so great that the radio frequency fields still couple to the conductors. This second limitation will now be discussed in some detail below.

When a conductive/resistive material is subjected to a radio frequency field, the currents flow on and near the surface of the material. The maximum current density is on the surface and the current decays exponentially away from the surface. This phenomenon is called the "skin effect". The distance over which the current density drops to a value 1/e of its initial value is called the skin depth δ, the skin depth δ being equal to $$\delta = \frac{1}{\sqrt{\pi\sigma f \mu_r \mu_o}}$$

where σ is the conductivity of the material, f is the frequency, $\mu_r$ is the magnetic permeability relative to that of free space, and $\mu_o$ is the magnetic permeability of free space.

For almost all materials $\mu_r$ is close to unity.

A material whose thickness is about the same as or less than its skin depth is ineffective at shielding anything it encloses from the effects of electric fields. If such a material were to be used for the intended purpose as radio shielding of cables, then the radio frequency signals would still couple to the cable's conductors 12 to 20 and they could support (somewhat attenuated) (perhaps resonant) radio frequency currents. Therefore the resistive material forming the layer 28 should be somewhat thicker than its skin depth, for example, 2 to 10 times the skin depth are often taken as acceptable thicknesses.

A cable suitable for interconnecting hand portable equipment may have a thickness of the order of a few millimeters. A 4 millimeter diameter cable would be considered thick for some applications. In order to avoid making the cable unacceptably thick, the thickness of the resistive layer 28 should be about 0.5 mm thick, thereby increasing the diameter by 1 mm. As a numeric example consider an equipment operating at 900 Mhz and using a cable having a requirement of 5 times the skin depth thickness for the resistive layer. These requirements are substituted into the above equation and the terms rearranged to give the conductivity of the material σ having a value greater than approximately 28000 S/m (Siemens per meter). This is a much lower than the conductivity of all commonly used metals for example copper is $5.7\times10^6$ S/m and stainless steel which is $1.1\times10^6$ S/m. Graphite has a conductivity of about $7\times10^4$ S/m and is well known for its resistive applications.

Due to its bulk resistance, graphite is from several points of view a useful material for the resistive layer 28. The graphite may be used in several ways. For example the graphite could be formed into carbon fibre formed by extruding graphite into thin filaments which have some flexibility. The technology for making carbon fibres and also to weave them is well established and therefore a resistive layer can be fabricated economically. In another example the resistive layer could be constructed from plastics loaded with high concentrations of graphite powder to give a material having an increase in resistivity over that of solid graphite.

While the bulk conductivity of graphite and all popular metals differ by about 1000 times because of the skin effect, the conductivity at radio frequencies differs by only the square root of the bulk conductivity. Consequently the resistance of the resistive layer 28 is about 30 times greater than that of the conductors 12 to 20 which are being isolated from an external radio frequency field.

Figure 2:
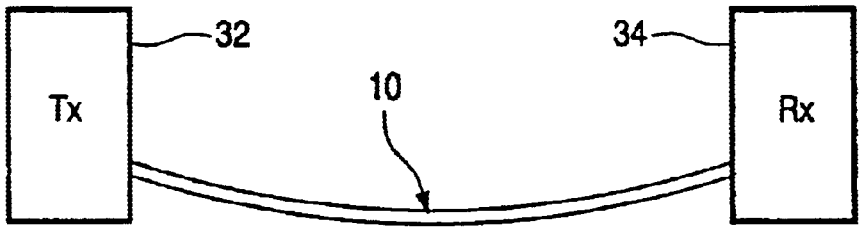
FIG. 2 is a block schematic diagram of an equipment comprising devices interconnected by a cable made in accordance with the present invention.

Referring to FIG. 2 the apparatus comprises a transmitting device 32 coupled to a receiving device 34 by way of a cable 10 made in accordance with the present invention. The devices 32 and 34 may comprise radio frequency test and measurement devices or equipment and devices for use in a mobile radio environment.

Although the resistive layer 28 has been described as suppressing emissions from the cable 10, the resistive layer 28 may also suppress external rf radiation from reaching the conductors.

In the present specification and claims the word "a" or "an" preceding an element does not exclude the presence of a plurality of such elements. Further, the word "comprising" does not exclude the presence of other elements or steps than those listed.

From reading the present disclosure, other modifications will be apparent to persons skilled in the art. Such modifications may involve other features which are already known in the design, manufacture and use of radio frequency suppressing cables and component parts therefor and which may be used herein instead of or in addition to features already described herein.

What is claimed is:

1. A cable comprising at least one conductor and a resistive layer surrounding and being insulated from the at least one conductor, wherein the bulk resistance of material comprising the resistive layer is greater than that of the material comprising the at least one conductor and the thickness of the resistive layer is greater than the skin depth of the resistive layer for a particular frequency.

2. A cable as claimed in claim 1, characterised in that the thickness of the resistive layer is greater than the skin depth δ, the skin depth δ being equal to $$\delta = \frac{1}{\sqrt{\pi\sigma f \mu_r \mu_o}}$$

where σ is the conductivity of the material, f is the frequency, $\mu_r$ is the magnetic permeability relative to that of free space, and $\mu_o$ is the magnetic permeability of free space.

3. A cable as claimed in claim 1, characterised by a plurality of mutually insulated conductors surrounded by the resistive layer.

4. A cable as claimed in claim 1, characterised in that the thickness of the resistive layer is between 2 and 10 times the skin depth δ.

5. A cable as claimed in claim 1, characterised in that the resistive layer is flexible.

6. A cable as claimed in claim 1, characterised in that the resistive layer is of a carbon based resistive material.

7. A cable as claimed in claim 1, characterised in that the resistive layer comprises graphite.

8. A cable as claimed in claim 1, characterised in that the resistive layer comprises carbon impregnated silicone.

9. A cable as claimed in claim 1, characterised in that the resistive layer comprises woven carbon fibre.

10. A cable as claimed in claim 1, characterised in that the resistive layer comprises graphite loaded plastics.

11. An apparatus including a transmitting device, a receiving device and a cable as claimed in claim 1 for coupling together electrically the transmitting and receiving devices.

* * * * *